US007361207B1

(12) United States Patent
Coffey et al.

(10) Patent No.: US 7,361,207 B1
(45) Date of Patent: Apr. 22, 2008

(54) SYSTEM AND METHOD FOR ELECTROSTATICALLY DEPOSITING AEROSOL PARTICLES

(75) Inventors: Calvin Thomas Coffey, Watkins Glen, NY (US); Andrey V Filippov, Painted Post, NY (US); Clinton Damon Osterhout, Beaver Dams, NY (US); Martin Andrew Sala, Campbell, NY (US); Carlton Maurice Truesdale, Corning, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 11/711,930

(22) Filed: Feb. 28, 2007

(51) Int. Cl.
*B03C 3/011* (2006.01)

(52) U.S. Cl. ..... 95/78; 95/79; 96/62; 96/69; 96/79; 96/88; 96/95; 96/98

(58) Field of Classification Search ..... 96/60, 96/62, 69, 77–80, 88, 95–98; 95/59, 61, 95/78, 79
See application file for complete search history.

(56) References Cited

U.S. PATENT DOCUMENTS

| | | | | | |
|---|---|---|---|---|---|
| 1,994,259 | A | * | 3/1935 | Thorne | 174/31 R |
| 3,033,918 | A | * | 5/1962 | Wiemer | 96/50 |
| 3,181,285 | A | * | 5/1965 | Tepolt et al. | 96/79 |
| 3,362,134 | A | * | 1/1968 | Wiemer | 96/26 |
| 4,077,783 | A | * | 3/1978 | Honacker | 96/88 |
| 4,117,255 | A | * | 9/1978 | Kawaike et al. | 96/50 |
| 4,177,047 | A | * | 12/1979 | Goland | 96/88 |
| 4,294,591 | A | * | 10/1981 | Kahl | 96/43 |
| 4,300,922 | A | * | 11/1981 | Gupner | 96/88 |
| 4,578,088 | A | * | 3/1986 | Linscheid | 95/78 |
| 4,618,351 | A | * | 10/1986 | Esper et al. | 96/88 |
| 4,634,806 | A | * | 1/1987 | Haag et al. | 174/211 |
| 4,892,579 | A | | 1/1990 | Hazelton | 75/0.5 B |
| 5,006,134 | A | * | 4/1991 | Knoll et al. | 96/88 |
| 5,147,423 | A | * | 9/1992 | Richards | 96/62 |
| 5,421,863 | A | * | 6/1995 | Rector et al. | 96/60 |
| 5,458,757 | A | * | 10/1995 | MacEdmondson | 204/662 |
| 5,482,540 | A | * | 1/1996 | Trinward et al. | 95/57 |
| 5,979,185 | A | | 11/1999 | Blackwell et al. | 65/17.4 |
| 6,260,385 | B1 | | 7/2001 | Sempolinski et al. | 65/17.4 |
| 6,487,879 | B1 | | 12/2002 | Blackwell et al. | 65/414 |
| 6,878,930 | B1 | | 4/2005 | Willoughby et al. | 250/281 |

(Continued)

FOREIGN PATENT DOCUMENTS

| | | | | |
|---|---|---|---|---|
| GB | 2119291 | A * | 11/1983 | 96/88 |

(Continued)

OTHER PUBLICATIONS

Corning Incorporated Application entitled "Apparatus For Particle Synthesis" filed Aug. 10, 2006.

(Continued)

*Primary Examiner*—Richard L Chiesa
(74) *Attorney, Agent, or Firm*—Tina N. Thompson

(57) ABSTRACT

A system useful for electrostatic deposition (ESD) of aerosol particles and methods of depositing the aerosol particles onto a substrate are disclosed. The ESD system and the method of the present invention are useful for electrostatically depositing nanoparticles produced by gas-phase synthesis, using an induction particle generator, onto a substrate. Direct current may be used with minimized corona leakage in the system, which would otherwise be damaging to the induction particle generator.

22 Claims, 2 Drawing Sheets

U.S. PATENT DOCUMENTS

| | | | | |
|---|---|---|---|---|
| 6,923,979 | B2 | 8/2005 | Fotland et al. | 424/439 |
| 2002/0085977 | A1 | 7/2002 | Fotland et al. | 424/45 |
| 2003/0136153 | A1 | 7/2003 | Marley et al. | 65/144 |
| 2004/0187525 | A1 | 9/2004 | Coffey et al. | 65/390 |
| 2004/0206127 | A1 | 10/2004 | Coffey et al. | 65/390 |
| 2005/0100666 | A1 | 5/2005 | Hampden-Smith et al. | 427/212 |
| 2005/0120752 | A1 | 6/2005 | Brown et al. | 65/397 |
| 2005/0147752 | A1 | 7/2005 | Kodas et al. | 427/249.1 |
| 2005/0223899 | A1* | 10/2005 | Kulmala et al. | 96/59 |

FOREIGN PATENT DOCUMENTS

| | | |
|---|---|---|
| WO | WO00/61282 | 10/2000 |
| WO | WO01/16376 | 3/2001 |

OTHER PUBLICATIONS

Corning Incorporated Application entitled "Apparatus and Method for Electrostatically Depositing Aerosol Particles" , filed Feb. 28, 2007.

* cited by examiner

SYSTEM AND METHOD FOR ELECTROSTATICALLY DEPOSITING AEROSOL PARTICLES

BACKGROUND

1. Field of the Invention

The present invention relates generally to electrostatic deposition (ESD) of aerosol particles and more particularly to a system useful for ESD and methods of depositing the aerosol particles onto a substrate.

2. Technical Background

Over the years, there has been rapid progress in the areas of electronics, materials science, and nanoscale technologies resulting in, for example, smaller devices in electronics, advances in fiber manufacturing and new applications in the biotechnology field. The ability to generate and collect increasingly smaller, cleaner and more uniform particles is necessary in order to foster technological advances in areas which utilize small particulate matter. The development of new, efficient and adaptable ways of producing small particulate matter and subsequently collecting or depositing the small particulate matter onto a substrate becomes more and more advantageous.

The size of a particle often affects the physical and chemical properties of the particle or compound comprising the particle. For example, optical, mechanical, biochemical and catalytic properties often change when a particle has cross-sectional dimensions smaller than 200 nanometers (nm). When particle sizes are reduced to smaller than 200 nm, these smaller particles of an element or a compound often display properties that are quite different from those of larger particles of the same element or compound. For example, a material that is catalytically inactive in the macroscale can behave as a very efficient catalyst when in the form of nanoparticles.

The aforementioned particle properties are valuable in many technology areas. For example, in optical fiber manufacturing, the generation of substantially pure silica and germanium soot particles from impure precursors in a particular size range (about 5-300 nm) has been key in providing optical preforms capable of producing high purity optical fiber. Also, in the field of pharmaceuticals, the generation of particles having certain predetermined properties is advantageous in order to optimize, for example, in vivo delivery, bioavailability, stability of the pharmaceutical and physiological compatibility. The optical, mechanical, biochemical and catalytic properties of particles are closely related to the size of the particles and the size of the compounds comprising the particles. Gas-phase methods of particle generation are attractive, since gas-phase methods typically yield large quantities of high purity particles which are within a desirable size range.

Particle generators such as aerosol reactors have been developed for gas-phase nanoparticle synthesis. Examples of these aerosol reactors include flame reactors, tubular furnace reactors, plasma reactors, and reactors using gas-condensation methods, laser ablation methods, and spray pyrolysis methods.

In particular, hot wall tubular furnace reactors have proven adept for soot particle generation for silica preform production in optical fiber manufacturing, for example, those described in commonly owned US Patent Application Publications 2004/0187525 and 2004/0206127, the disclosures of which are incorporated herein by reference in their entirety.

Induction particle generators are examples of hot wall tubular furnace reactors using inductive heating elements to heat the reactor walls. Examples of such induction particle generators are described in commonly owned U.S. patent application Ser. No. 11/502,286, filed on Aug. 10, 2006, the disclosure of which is incorporated herein by reference in its entirety, and may be used to produce a flow of aerosol containing aerosol particles dimensionally in the nanometer range.

Enhanced surface area is an enabling physical property for many applications, such as custom spotted microarrays, high display of surface area for catalysis, high display of luminescent elements and the like. Conventional methods of producing enhanced surface area, such as the method described in PCT Publication No. WO0116376A1, the disclosure of which is incorporated herein by reference in its entirety, ball milled Corning 1737™ glass particles of size range from 0.5 μm to 2 μm. These ball milled particles are sintered onto Corning 1737™ glass substrates. Deposits of nanoparticles provide optimum surface area. However, particles in this nanometer size range are difficult to produce and deposit onto a substrate.

One method of depositing aerosol particles onto a substrate currently being explored is electrostatic deposition (ESD) for various applications, for example, in electrostatic scrubbers for pollution abatement and in electro-painting. U.S. Pat. No. 4,892,579 for example, describes a process of preparing an amorphous metal alloy body from elemental metal powders by dispersing and mixing the elemental powders in the aerosol state, collecting them either electrostatically or using a cyclone and compaction using an isostatic hot-press. U.S. Pat. No. 6,923,979 describes a method for depositing particles in the micron range onto a dielectric substrate using an alternating electric field.

It would be advantageous to have system and a method for electrostatically depositing nanoparticles produced by gas-phase synthesis, using an induction particle generator, onto a substrate utilizing direct current with minimized corona leakage in the system, which would otherwise be damaging to the induction particle generator.

SUMMARY OF THE INVENTION

The system for ESD and ESD methods of the present invention as described herein, address the above-mentioned disadvantages of the conventional ESD methods, in particular, when the desired particles are dimensionally in the nanometer range.

In one embodiment of the present invention, a system for electrostatically depositing aerosol particles is disclosed. The system comprises an induction particle generator, a charging zone, an electrostatic deposition zone and an insulator positioned with respect to one another, such that a flow of aerosol can be passed from the induction particle generator through the insulator, then through the charging zone and subsequently to the electrostatic deposition zone.

The charging zone comprises a pair of corona discharge electrodes spaced apart and facing one another and adapted to receive a flow of aerosol from the induction particle generator between the corona discharge electrodes.

The insulator is positioned between the induction particle generator and the charging zone. The insulator comprises a surface surrounding the outlet of the induction particle generator and extending outwardly so as to insulate the induction particle generator from any corona paths generated by the corona discharge electrodes, thus minimizing damage to the induction particle generator.

The electrostatic deposition zone comprises a pair of deposition electrodes spaced apart and facing one another. The electrostatic deposition zone is adapted to receive a flow of aerosol particles from the charging zone between the deposition electrodes.

In another embodiment of the present invention, a method for electrostatically depositing aerosol particles is disclosed. The method comprises: generating a flow of aerosol produced by an induction particle generator; passing the generated flow of aerosol through an insulator; passing the flow of aerosol between a pair of corona discharge electrodes; applying direct current to the corona discharge electrodes to charge the aerosol particles passing there between, forming charged aerosol particles; passing the charged aerosol particles between a pair of deposition electrodes, at least one of which have a substrate attached thereto; and applying direct current to the electrodes to produce an electric field between the deposition electrodes that deposits the charged aerosol particles onto the substrate.

The insulator, in the passing the generated flow of aerosol particles through an insulator step of the method, comprises a surface surrounding the outlet of the induction particle generator and extending outwardly so as to insulate the induction particle generator from any corona paths generated by the corona discharge electrodes.

Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that both the foregoing general description and the following detailed description are merely exemplary of the invention, and are intended to provide an overview or framework to understanding the nature and character of the invention as it is claimed.

The accompanying drawings are included to provide a further understanding of the invention, and are incorporated in and constitute a part of this specification. The drawings illustrate one or more embodiment(s) of the invention and together with the description serve to explain the principles and operation of the invention.

BRIEF DESCRIPTION OF THE DRAWINGS

The invention is best understood from the following detailed description when read with the accompanying drawing figures.

DETAILED DESCRIPTION

Reference will now be made in detail to various embodiments of the invention, examples of which are illustrated in the accompanying drawings. Wherever possible, the same reference numbers will be used throughout the drawings to refer to the same or like parts.

Figure 1:
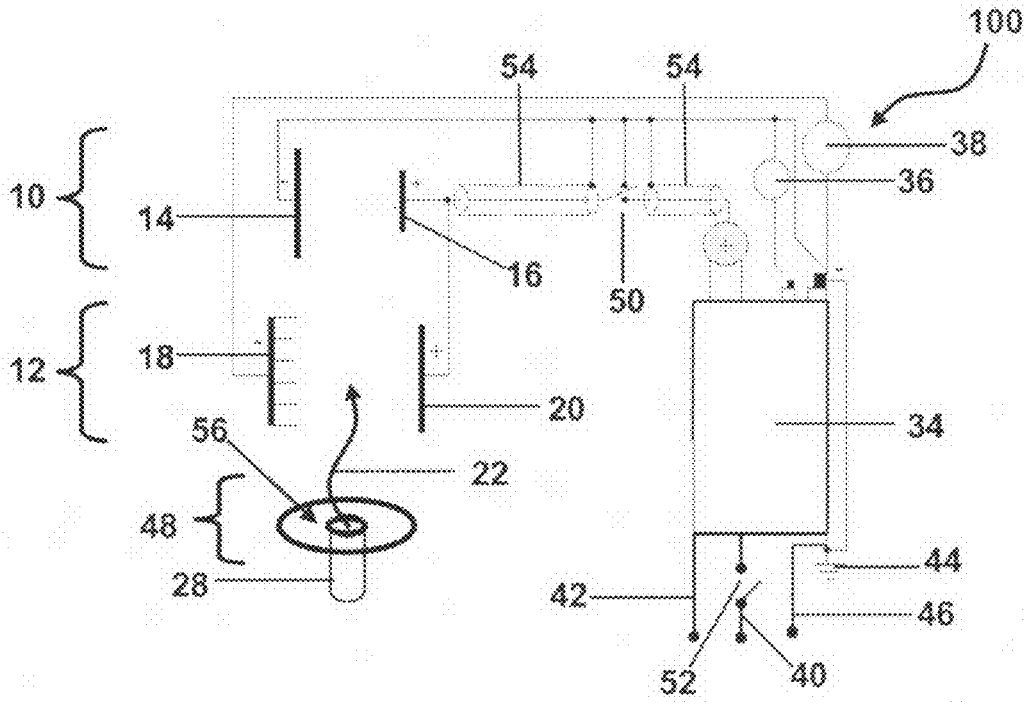
FIG. 1 is a schematic of the ESD system according to one embodiment of the present invention.

An exemplary ESD system according to one embodiment of the present invention is shown in the schematic in FIG. 1. The ESD system 100 comprises an induction particle generator 28, a charging zone 12, an electrostatic deposition zone 10 and an insulator 48 positioned with respect to one another, such that a flow of aerosol 22 can be passed from the induction particle generator through the insulator, then through the charging zone and subsequently to the electrostatic deposition zone.

Exemplary induction particle generators, for example, those described commonly owned US Patent Application Publications 2004/0187525, 2004/0206127 and U.S. patent application Ser. No. 11/502,286, may be used to produce a flow of aerosol 22.

A flow of aerosol according to one embodiment can comprise carrier gases, for example, nitrogen, oxygen and the like or combinations thereof and precursors, reactants, particles and the like or combinations thereof.

Aerosol particles produced by gas-phase synthesis are typically charged positively or negatively during chemical reactions used to produce the aerosol particles. According to the present invention, any such charged aerosol particles can be additionally charged by acquiring charge from airborne ions produced by corona chargers.

As shown in FIG. 1, the charging zone 12 comprises a pair of corona discharge electrodes 18 and 20 which are spaced apart and facing one another and adapted to receive a flow of aerosol 22 from the induction particle generator 28 between the corona discharge electrodes.

In the absence of an insulator and because of the current passing between the corona discharge electrodes, a corona leakage path occurring intermittently is established to the top edge of the induction particle generator's platinum-rhodium susceptor. The corona leakage path travels down the surface of the susceptor through a hole in the surrounding quartz tube and travels through to the induction coil of the induction particle generator and to the power supply of the induction particle generator. This intermittent corona leakage path causes arcing and results in erratic induction particle generator heating and ultimately damages the induction particle generator. In order to minimize this corona leakage path, an insulator was added to the ESD system as illustrated in the Figures.

As shown in FIG. 1, the insulator 48 is positioned between the induction particle generator 28 and the charging zone 12. The insulator comprises a surface 56 surrounding the outlet of the induction particle generator 28 and extending outwardly so as to insulate the induction particle generator from any corona leakage paths generated by the corona discharge electrodes 18 and 20, thus minimizing damage to the induction particle generator.

The electrostatic deposition zone 10 comprises a pair of deposition electrodes 14 and 16 spaced apart and facing one another. The electrostatic deposition zone is adapted to receive a flow of aerosol from the charging zone 12 between the deposition electrodes 14 and 16.

As shown in FIG. 1, the ESD system of the present invention may further comprise a variable power source of direct current (DC) 34 connected to the corona discharge electrodes 18 and 20 and the deposition electrodes 14 and 16. The variable power source of direct current enables optimization of the deposition process parameters and should be capable, in one embodiment, of providing 0 to 75 thousand Volts Direct Current (kVDC). A voltmeter 36 and micro-ammeter 38 are included to permit monitoring of voltage and current being supplied to the respective electrodes. High voltage coaxial cable 54 supplies the power to one of the pair of corona discharge electrodes 20 and one of the pair of deposition electrodes 16 which are positive in polarity in this embodiment. Relay 50 is included for safety of the operator of the ESD system and is activated in conjunction with the variable power source of direct current ON-OFF switch 52, such as to ensure that electrodes 16 and 20 are totally discharged to ground 44 when the variable power source of direct current 34 is switched OFF. In the safety switch, location 40 is 'Live', location 42 is 'Neutral' and location 46 is 'Ground' for a 120 volt, 60 hertz current supply.

Figure 2:
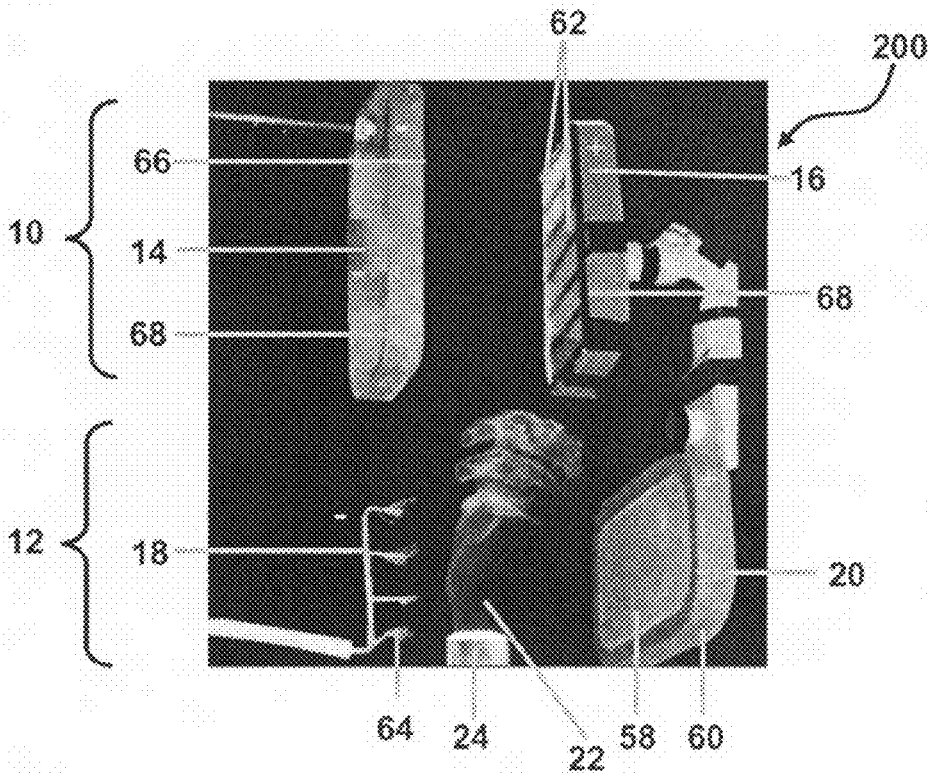
FIG. 2 is a photograph of features in an embodiment of the ESD system according to the present invention.

Features of an exemplary ESD system according to another embodiment of the present invention are shown in the photograph in FIG. 2. In the features of the ESD system 200, in the charging zone 12, one of the pair of corona discharge electrodes 18 comprise multiple corona wires 64 having an even delta profile. The efficiency of the charging is increased by increasing the delta area of the corona wires and by having multiple bundles of corona wires located in two or more parallel rows within corona discharge electrode 18. FIG. 2 illustrates the top of chimney 24, which forms part of the insulator in this embodiment.

Also, one of the pair of corona discharge electrodes 20 has an outer surface 58 which is a conductive material. Although aluminum is shown as the conductive material in the embodiment in FIG. 2, the conductive material could be, as an alternative, copper, brass, stainless steel, steel and combinations thereof.

Furthermore, the corona discharge electrode 20 in FIG. 2 is coated with a non-conductive material throughout the perimeter of the outer surface 60. Although, high temperature silicon is shown in the embodiment in FIG. 2, the non-conductive material could be, as an alternative, quartz, fused silica, ceramic, mica and combinations thereof. The corona discharge electrode 20 in FIG. 2 is rectangular in shape with rounded corners which further minimizes corona path leakage from the charging zone. Further the corners, edges, radii or unused surfaces of the corona discharge electrode 20 can be embedded in silicon.

The charged aerosol particle concentration that deposits on the substrate 62 in this embodiment can be controlled by the flow rate of the aerosol 22 and the charging of the aerosol particles in the flow of aerosol. The charging can be controlled by using unipolar constant corona chargers.

If the charge is constant, the deposit can be made continuous. Typically, a corona charger has sharp corona electrodes (wires, needles etc.) producing ions in the air/carrier gas and smooth ion receiving electrodes, separated by an inter-electrode space, where a flow of aerosol flow is forwarded. The ions cross the flow and those colliding with the particles give up their charge, thus effectively charging. At high aerosol particle concentration, all of the ions produced by the corona discharge are captured by the aerosol particles.

In the electrostatic deposition zone 10 of this embodiment, the electrodes in the pair of deposition electrodes 14 and 16 each have an outer surface 66 comprising a conductive material. Although aluminum is shown as the conductive material in the embodiment in FIG. 2, the conductive material could be, as an alternative, copper, brass, stainless steel, steel and combinations thereof.

In order to minimize corona path leakage from the charging zone, the deposition electrodes 14 and 16 in FIG. 2 are coated with a non-conductive material throughout the perimeter of the outer surface 68. Although, high temperature silicon is shown in the embodiment in FIG. 2, the non-conductive material could be, as an alternative, quartz, fused silica, ceramic, mica and combinations thereof. The deposition electrodes are rectangular in shape with rounded corners which further minimizes corona path leakage from the charging zone. Further the corners, edges, radii or unused surfaces of the deposition electrodes can be embedded in silicon.

Figure 3:
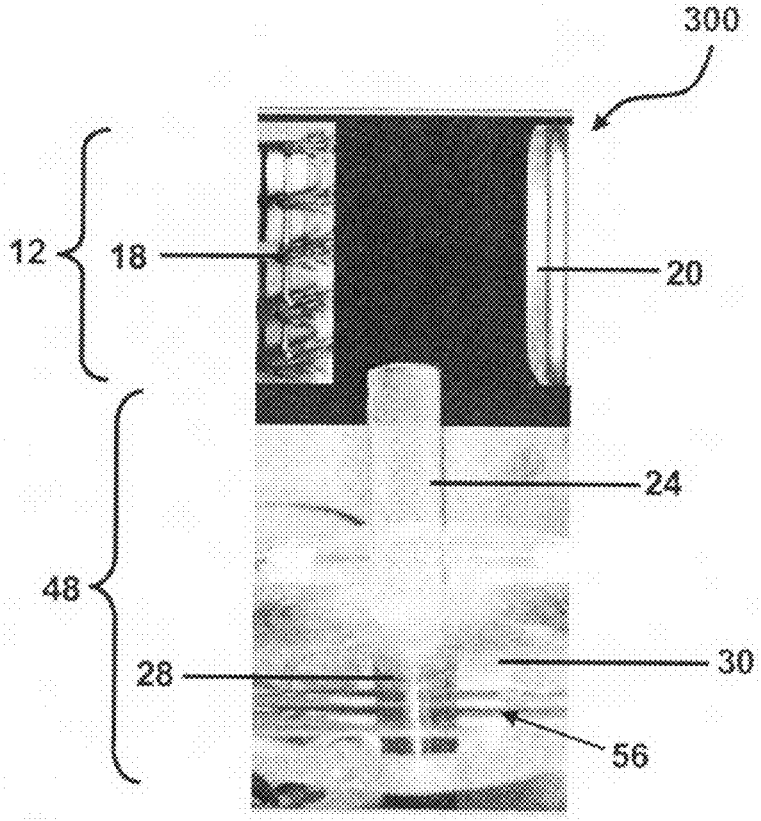
FIG. 3 is a photograph of the charging zone and the insulator comprising a disk and a chimney in the ESD system according to another embodiment of the present invention.

The corona discharge electrodes shown in FIG. 2 and FIG. 3 are spaced from 2 inches to 10 inches apart from one another and are positioned from 1 inch to 5 inches from the insulator 48.

The deposition electrodes 14 and 16 shown in FIG. 2 are spaced from 2 inches to 8 inches apart from one another and are positioned from 1 inch to 3 inches from the pair of corona discharge electrodes.

The spacing of the corona discharge electrodes relative to each other and with respect to the deposition electrodes can be selected based upon the voltage being supplied to the system. The spacing of the electrodes generally increases as the voltages increase. Typically, when spacing the electrodes, the electrodes are moved closer to each other until arcing between the electrodes is realized. At this point, the spacing of the electrodes is increased until the arcing ceases between the electrodes.

In FIG. 2, a substrate or several substrates 62 are positioned on at least one electrode in the pair of deposition electrodes. The substrates shown in this embodiment are Corning 1737™ glass slides which are deposited with the charged aerosol particles in the electrostatic deposition zone under the control of a direct current induced electric field.

In the features of an embodiment of the present invention shown by the photograph in FIG. 3, the features 300 illustrate the insulator 48 comprising a disk 30 comprising a surface 56 and a diameter equal to or greater than the distance between the pair of corona discharge electrodes 18 and 20 in the charging zone 12. The insulator 48 shown in this embodiment also comprises a chimney 24 positioned between the disk 30 and the charging zone 12 and positioned to receive a flow of aerosol passing from the induction particle generator 28.

In FIG. 1, FIG. 2 and FIG. 3, the insulator 48 (in the case of FIG. 2, shown partly by chimney 24) is positioned between the induction particle generator 28 and the charging zone 12. The insulator comprises a surface 56 surrounding the outlet of the induction particle generator 28 and extending outwardly so as to insulate the induction particle generator from any corona paths generated by the corona discharge electrodes 18 and 20, thus minimizing damage to the induction particle generator.

The insulator in the ESD system of the present invention may comprise, for instance, a high temperature non-conductive material. Although both the disk 30 and the chimney 24 are quartz in the embodiment shown in FIG. 3, the high temperature non-conductive material could be, as an alternative, fused silica, ceramic, mica and combinations thereof. In one embodiment, the insulator is a disk, for example, 2 to 10 inches in diameter and comprising a high temperature non-conductive material. In another embodiment, the insulator is square or rectangular in shape. In some embodiments, the insulator, such as a disk or square or rectangle, forms a planar surface. In other embodiments, the insulator comprises a concave or convex surface or forms an otherwise non-planar surface.

The thickness of the disk and the walls of the chimney can be selected depending upon operating temperatures of the induction particle generator. Quartz disks having thicknesses in the range of 1/16 of an inch to 2 inches are usually sufficient for temperatures above 600 degrees Celsius and are able to insulate from corona leakage paths at temperatures above 1500 degrees Celsius. Similarly, quartz chimneys having wall thicknesses in the range of 1/16 of an inch to 2 inches and from ½ inch to 3 inches in diameter are usually sufficient for temperatures above 600 degrees Celsius and are able to insulate from corona leakage paths at temperatures above 1500 degrees Celsius.

Figure 4:
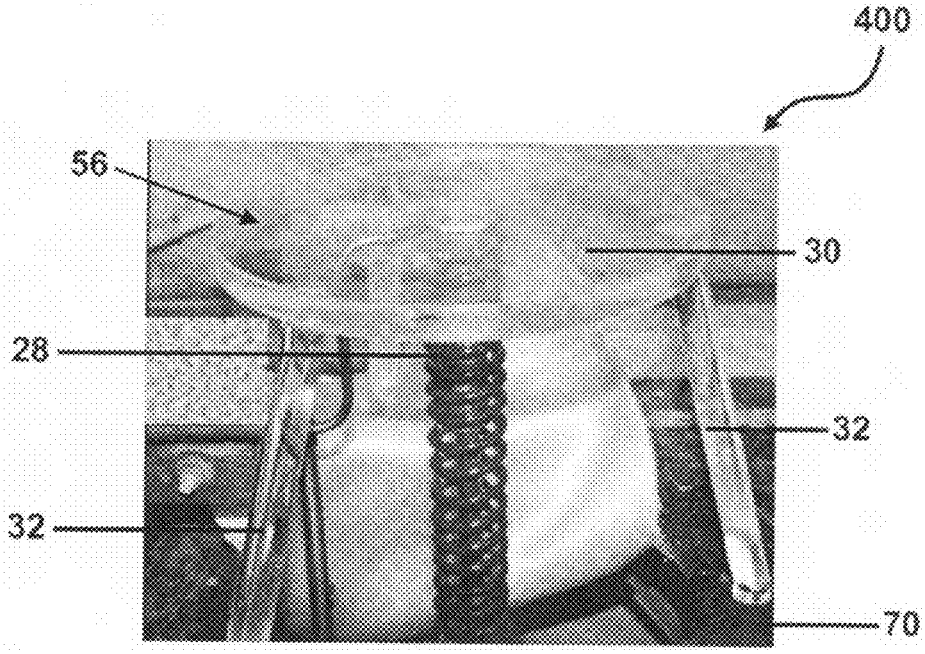
FIG. 4 is a photograph of the induction particle generator and insulator according to another embodiment of the present invention with the insulator comprising a disk having legs extending therefrom.

In the illustration of the induction particle generator and insulator in an embodiment 400 shown by the photograph in FIG. 4, the insulator comprises a disk 30 comprising a surface 56 comprising legs 32 extending between the disk 30 and a surface 70 located below the insulator and around the induction particle generator 28. In this embodiment, the disk can be suspended, for example ⅛ inch to one inch above the induction particle generator. In another embodiment, the disk can be attached to the particle generator.

In another embodiment of the present invention, a method for electrostatically depositing aerosol particles which utilizes the above-mentioned system is disclosed. The method comprises: generating a flow of aerosol produced by an induction particle generator; passing the generated flow of aerosol through an insulator; passing the flow of aerosol between a pair of corona discharge electrodes; applying direct current to the corona discharge electrodes to charge the aerosol particles passing there between, forming charged aerosol particles; passing the charged aerosol particles between a pair of deposition electrodes, at least one of which have a substrate attached thereto; and applying direct current to the electrodes to produce an electric field between the deposition electrodes that deposits the charged aerosol particles onto the substrate.

The insulator, in the passing the generated flow of aerosol particles through an insulator step of the method, comprises a surface surrounding the outlet of the induction particle generator and extending outwardly so as to insulate the induction particle generator from any corona paths generated by the corona discharge electrodes.

In one embodiment, the insulator is a disk which is 2 to 10 inches in diameter and comprises a material selected from quartz, fused silica, ceramic, mica and combinations thereof.

In an additional embodiment, the step of passing the flow of aerosol through the insulator further comprises passing the flow of aerosol through a chimney located between the charging zone and the disk, such that the aerosol passes from the induction particle generator through the disk and through the chimney into the charging zone.

EXAMPLE

A flow of aerosol comprising titania nanoparticles was generated in a tubular hot-wall reactor with inductively-heated Pt—Rh walls (induction particle generator) having an inner diameter of 0.03 meters (m) and an effective length of the heated zone of 0.2 m. The highest temperature inside the tubular hot-wall reactor was found to be at the inner wall close to the exit from the heated zone of the tubular hot-wall reactor and was measured using an infrared pyrometer.

A flow of aerosol comprising a mixture of oxygen, nitrogen and $TiCl_4$ vapor was introduced into the tubular hot-wall reactor at a temperature about 600 Kelvin (K). The maximum temperature in the reactor varied between 750 K and 1650 K (Process A). At the exit of the tubular hot-wall reactor, the aerosol particles were charged using a corona charger, collected electrostatically onto borosilicate glass slides and studied using X-ray diffraction analysis, TEM and SEM. It appeared that regardless of the reaction temperature, all samples were composed of a mixture of crystalline rutile and anatase agglomerated particles with polyhedral primary particle diameter about 50 to 80 nm.

In order to get pure anatase aerosol with the system described above, an alternative process (process B) was suggested, where the oxygen was absent from the gas composition in initial flow of aerosol. The mixture of nitrogen and $TiCl_4$ was heated in the reactor to a temperature in the range between 800 K and 1650 K and mixed with the atmospheric oxygen only after exiting the tubular hot-wall reactor. Contrary to process A, all samples showed an absence of rutile and a clear signal from the anatase phase, regardless of the reactor temperature and conditions being studied. Most of the particles produced in process B have a nearly spherical shape and are 50 nm to 80 nm in diameter. In both processes, the primary particle and agglomerate size depended on the tubular hot-wall reactor temperature.

It will be apparent to those skilled in the art that various modifications and variations can be made to the present invention without departing from the spirit or scope of the invention. Thus, it is intended that the present invention cover the modifications and variations of this invention provided they come within the scope of the appended claims and their equivalents.

What is claimed is:

1. A system for electrostatically depositing aerosol particles comprising:

an induction particle generator;

a charging zone comprising a pair of corona discharge electrodes spaced apart and facing one another and adapted to receive a flow of aerosol from the induction particle generator between the corona discharge electrodes;

an insulator positioned between the induction particle generator and the charging zone; and an electrostatic deposition zone comprising a pair of deposition electrodes spaced apart and facing one another and adapted to receive a flow of aerosol from the charging zone between the deposition electrodes;

wherein the insulator comprises a surface surrounding the outlet of the induction particle generator and extending outwardly so as to insulate the induction particle generator from any corona paths generated by the corona discharge electrodes.

2. The system according to claim 1, wherein the insulator comprises a planar surface.

3. The system according to claim 2, wherein the insulator comprises a disk having a diameter equal to or greater than the distance between the pair of corona discharge electrodes in the charging zone.

4. The system according to claim 3, wherein the disk is 2 to 10 inches in diameter and comprises a high temperature non-conductive material.

5. The system according to claim 4, wherein the high temperature non-conductive material is selected from quartz, fused silica, ceramic, mica and combinations thereof.

6. The system according to claim 3, wherein the insulator further comprises a chimney positioned between the disk and the charging zone and positioned to receive a flow of aerosol passing from the induction particle generator.

7. The system according to claim 6, wherein the chimney comprises a high temperature non-conductive material.

8. The system according to claim 7, wherein the high temperature non-conductive material is selected from quartz, fused silica, ceramic, mica and combinations thereof.

9. The system according to claim 1, further comprising a source of direct current (DC) connected to the corona discharge electrodes.

10. The system according to claim 1, further comprising a source of direct current (DC) connected to the deposition electrodes.

11. The system according to claim 1, wherein at least one in the pair of corona discharge electrodes comprises multiple corona wires having an even delta profile.

12. The system according to claim 1, wherein at least one in the pair of charging electrodes comprises an outer surface comprising a conductive material.

13. The system according to claim 12, wherein the conductive material is selected from aluminum, copper, brass, stainless steel, steel and combinations thereof.

14. The system according to claim 1, wherein the deposition electrodes are spaced from 2 inches to 8 inches apart from one another and are positioned from 1 inch to 3 inches from the pair of corona discharge electrodes.

15. The system according to claim 1, wherein the electrodes in the pair of deposition electrodes each comprise an outer surface comprising a conductive material.

16. The system according to claim 15, wherein the conductive material is selected from aluminum, copper, brass, stainless steel, steel and combinations thereof.

17. The system according to claim 15, wherein the electrodes in the pair of deposition electrodes further comprise a material selected from silicon, quartz, fused silica, ceramic, mica and combinations thereof located throughout the perimeter of the outer surface.

18. The system according to claim 1, further comprising a substrate positioned on at least one electrode in the pair of deposition electrodes.

19. The system according to claim 18, comprising two or more substrates positioned on at least one electrode in the pair of deposition electrodes.

20. A method for electrostatically depositing aerosol particles, the method comprising:

generating a flow of aerosol produced by an induction particle generator;

passing the generated flow of aerosol through an insulator;

passing the flow of aerosol between a pair of corona discharge electrodes;

applying direct current to the corona discharge electrodes to charge particles in the flow of aerosol passing there between, forming charged aerosol particles;

passing the charged aerosol particles between a pair of deposition electrodes, at least one having a substrate attached thereto; and applying direct current to the deposition electrodes to produce an electric field there between that deposits the charged aerosol particles onto the substrate;

wherein the insulator comprises a surface surrounding the outlet of the induction particle generator and extending outwardly so as to insulate the induction particle generator from corona paths generated by the corona discharge electrodes.

21. The method according to claim 20, wherein the insulator comprises a disk which is 2 to 10 inches in diameter and comprises a material selected from quartz, fused silica, ceramic, mica and combinations thereof.

22. The method according to claim 21, wherein the step of passing the flow of aerosol through the insulator further comprises passing the flow of aerosol through a chimney located between the charging zone and the disk, such that the aerosol passes from the induction particle generator through the disk and through the chimney into the charging zone.

* * * * *